US008833287B2

(12) United States Patent
Møgedal et al.

(10) Patent No.: US 8,833,287 B2
(45) Date of Patent: Sep. 16, 2014

(54) SUBSEA ANCHOR

(75) Inventors: Knut Møgedal, Asker (NO); Bard Kristiansen, Oslo (NO)

(73) Assignee: Aker Subsea AS, Lysaker (NO)

( * ) Notice: Subject to any disclaimer, the term of this patent is extended or adjusted under 35 U.S.C. 154(b) by 0 days.

(21) Appl. No.: 13/883,720

(22) PCT Filed: Nov. 7, 2011

(86) PCT No.: PCT/EP2011/069521
§ 371 (c)(1),
(2), (4) Date: May 6, 2013

(87) PCT Pub. No.: WO2012/062693
PCT Pub. Date: May 18, 2012

(65) Prior Publication Data

US 2013/0220206 A1 Aug. 29, 2013

(30) Foreign Application Priority Data

Nov. 9, 2010 (NO) ..... 20101581

(51) Int. Cl.
*B63B 21/24* (2006.01)
*E21B 41/08* (2006.01)
*B63B 21/27* (2006.01)

(52) U.S. Cl.
CPC ..... *B63B 21/27* (2013.01); *E21B 41/08* (2013.01)
USPC ..... 114/294; 405/224.1

(58) Field of Classification Search
USPC ..... 114/294; 405/224.1, 224.2
IPC ..... B63B 21/26,21/50
See application file for complete search history.

(56) References Cited

U.S. PATENT DOCUMENTS

| | | | | |
|---|---|---|---|---|
| 5,033,908 | A * | 7/1991 | Auraen | 405/204 |
| 5,915,326 | A | 6/1999 | Karal | |
| 6,910,831 | B2 | 6/2005 | Raines | |
| 2007/0221899 | A1 * | 9/2007 | Braithwaite | 254/418 |

FOREIGN PATENT DOCUMENTS

| | | | |
|---|---|---|---|
| GB | 2 054 710 | A | 2/1981 |
| WO | WO-2010103002 | A2 | 9/2010 |

OTHER PUBLICATIONS

Martinez, F., "International Search Report", for PCT/EP2011/069521, as mailed Feb. 27, 2012, 3 pages.

* cited by examiner

*Primary Examiner* — Stephen Avila
(74) *Attorney, Agent, or Firm* — Winstead PC

(57) ABSTRACT

Subsea anchor (1) having a hollow cylindrical body (3) extending down from a top part (13). The anchor has a top aperture (15) and a top hatch (17) which is adapted to close and open the top aperture (15). The cylindrical body (3) is adapted to penetrate into a seabed. The area of said aperture (15) is at least 30% of the corresponding cross section area encircled by the cylindrical body (3).

7 Claims, 5 Drawing Sheets

SUBSEA ANCHOR

The present invention relates to a subsea anchor for anchoring subsea equipment to the seabed.

BACKGROUND

For anchoring floating installations or subsea equipment to the sea floor, it is known to penetrate the seabed with cylinder shaped skirts. Some of these are known as suction anchors, which are arranged to penetrate the seabed by providing a lower pressure inside the cylinder than on the outside. Others are simply forced into the seabed by gravity. These anchors rely on friction forces between the cylindrical shaped skirt and the seabed.

Patent publication U.S. Pat. No. 6,910,831 describes an anchor which is arranged to penetrate into the seabed by providing a negative pressure inside of it.

In order to provide such a negative pressure the cylindrical shape of the anchor must be closed at the top section. Thus, the main shape of the anchor is the cylindrical side wall and a top plate. Furthermore, it is known to arrange a hatch in the top plate. By opening the hatch, one may penetrate the anchor a distance into the seabed by means of gravity. In addition, when lowering the anchor from the surface, it is advantageous to open the hatch in order to reduce resistance in the water and the added mass that arise when the velocity of the anchor in the water changes. For instance, if the anchor is lowered from a floating installation by means of a lifting crane, the pull in the crane cable may vary when larger waves changes the vertical position or the orientation of the installation. This is particularly crucial when lowering the anchor through the sea surface. In particular, one needs to avoid a slack cable which may disadvantageously affect the crane assembly.

As mentioned, it is known to open a top hatch in order to reduce the added mass. With an open hatch water can flow through the cylindrical shape of the anchor, as well as air when lowering through the sea surface. However, such top hatches of the prior art are disadvantageously small and contributes to reduction of the added mass only to a small extent. Some prior art solutions attempts to solve this by adding more hatches. Thus, some top plates of some anchors have two or three open hatches when lowering the anchor towards the seabed.

By increasing the number of top hatches, the added mass is reduced. However, having a circular top plate with two or three top hatches in it only opens a small part of the total area of the top plate of the anchor. Thus, much added mass remains as a result of the top plate. The present invention seeks to provide a solution to this problem.

THE INVENTION

According to the present invention, there is provided a subsea anchor having a hollow cylindrical body extending down from a top part. The top part has a top aperture which is closable with a top hatch. The top hatch is adapted to close and open the top aperture. The cylindrical body is adapted to penetrate into a seabed. According to the invention, the area of said top aperture is at least 30% of the corresponding cross section area that is encircled by the cylindrical body.

With such a top aperture and with the top hatch being in an open position, the resistance force from water when lowering or lifting the anchor through water is reduced to below half of the corresponding resistance with a closed top hatch or an anchor without a top hatch. More importantly, the added mass resulting from accelerated water masses when accelerating the anchor is reduced to approximately 10% of the comparable added mass with the top hatch closed. This is a result of the water within the cylindrical body being able to flow almost freely through the open aperture of such relative size. This is particularly advantageous when lowering the anchor through the wave zone with a cable crane on a floating installation, since added mass increases the risk of a slack cable.

In one preferred embodiment, the area of the aperture is at least 50% of the corresponding cross section area encircled by the cylindrical body. Such a percentage arise for instance with an anchor having a cylindrical body with a diameter of approximately 8 meters and a top aperture having a diameter of about 6 meters, or even less. With an area of the aperture of approximately 50%, the added mass is reduced to approximately zero.

In a further embodiment, the anchor comprises a support frame which is arranged to the top part. The support frame exhibits a central open portion, encircled by the frame. The central open portion renders space for movement of the top hatch between open and closed position through the support frame.

In one embodiment, the support frame comprises a well template with a plurality of well slots.

The support frame can advantageously comprise two levelling screws and a ball joint in order to facilitate levelling of the support frame, i.e. altering its orientation with respect to the anchor parts penetrating into the seabed. In addition the support frame may comprise two adjustable support screws which can be moved into contact with the top plate from the support frame, or vice versa. The support screws are then not used for levelling, but for providing additional points of support between the support frame and the top plate of the anchor.

Preferably, the cylindrical body exhibits a substantially circular shape and has an outer diameter being in the region of 3 to 12 meters. More preferably the diameter can be in the region of 6 to 10 meters.

In one embodiment of the present invention, the subsea anchor is arranged with a top frame comprising a well template with a plurality of well slots. This embodiment is particularly suited for use at large sea depths, such as at 1000 meters and more. The advantages of this embodiment will appear from the detailed description below.

EXAMPLE OF EMBODIMENT

Whereas some main features of the invention has been described in general terms above, a more detailed non-limiting description of an example of embodiment will be given in the following with reference to the drawings, in which FIG. 1 is a perspective view of an anchor according to the invention, with a top hatch in an open position;

Figure 1:
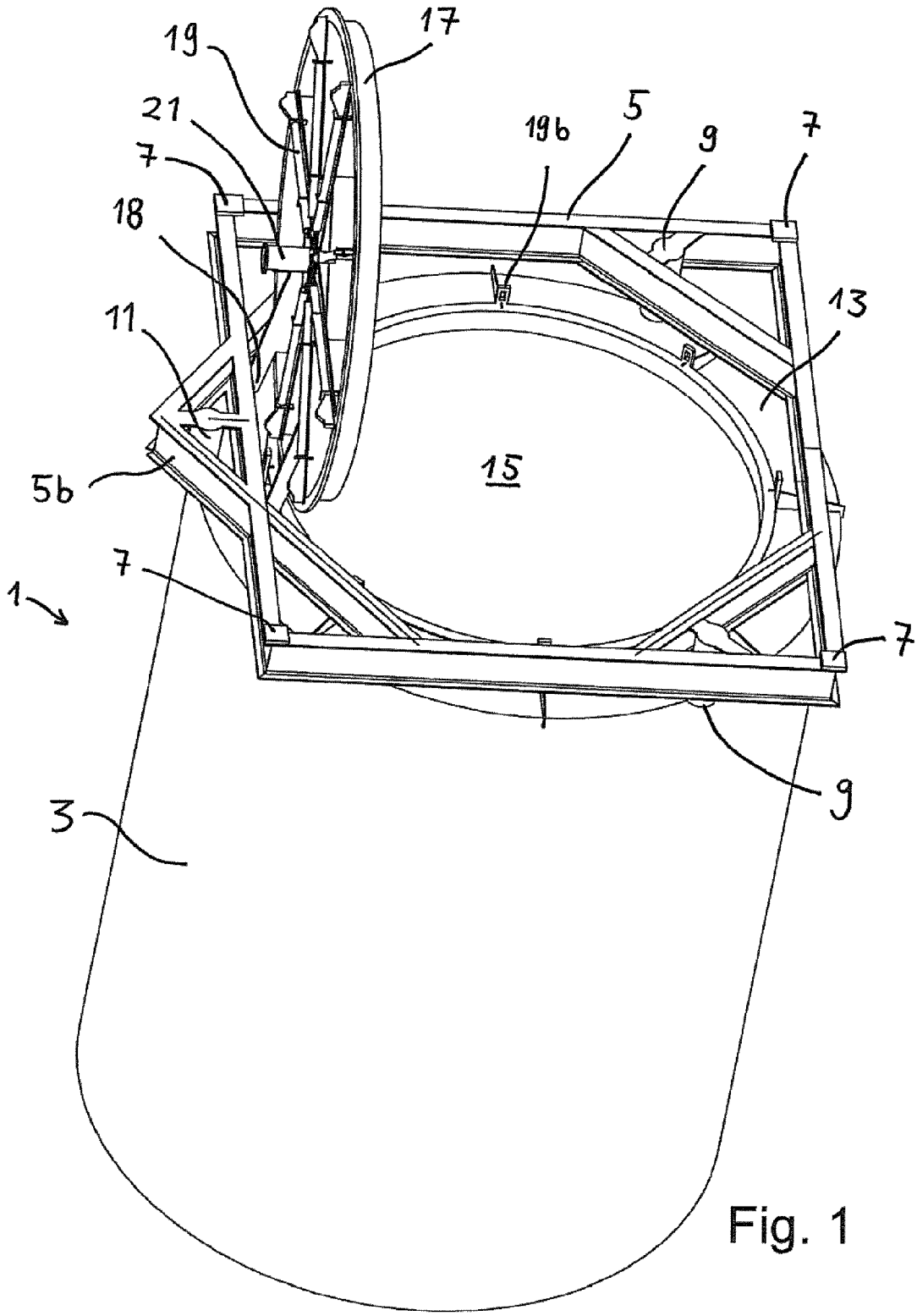

FIG. 1 shows an anchor 1 according to the present invention. The anchor 1 has a cylindrical body 3 which has a cylindrical wall with a thickness that is small compared to its inner diameter. Typical wall thicknesses can be in the region of 1 to 4 cm. The inner diameter of the cylindrical body 3 can for instance be 8 meters. It can however also be smaller, such as 3 or 6 meters, or in some cases larger, such as 10 or 12 meter.

On top of the cylindrical body 3 there is arranged a support frame 5 which is adapted to receive subsea equipment, such as a manifold (not shown) when the anchor is installed in the seabed. The support frame 5 has four support surfaces 7 onto which the subsea equipment will be adapted to land.

The interface between the support frame 5 and the cylindrical body 3 comprises two levelling screws 9 and a ball joint 11. When the anchor has penetrated into the seabed, the support frame 5 is levelled by adjusting the two levelling screws 9 with an ROV (remotely operated vehicle). During this process, the support frame 5 will pivot about the ball joint 11.

The support frame 5 has a substantially rectangular or quadratic shape and is constructed mainly of I-beams that are welded together. In addition it has a protruding part 5*b* that extends a bit outside the rectangular shape, in which part the ball joint 11 is arranged. It should be noted that the support frame 5 exhibits a large central portion without any parts. The levelling screws 9 and the ball joint 11 are advantageously arranged directly above the wall of the cylindrical body 3 in order to transfer forces vertically directly to the cylindrical body 3.

At the top of the cylindrical body 3 there is arranged a top plate 13 which exhibits a top aperture 15. The top aperture 15 can be opened and closed by a top hatch 17 which is attached to the top plate 13 with hinges 18. Furthermore, on the top hatch 17 there is arranged a hatch locking means 19 which can be operated by an ROV when the hatch 17 is in the closed position, as shown in FIG. 2.

Figure 2:
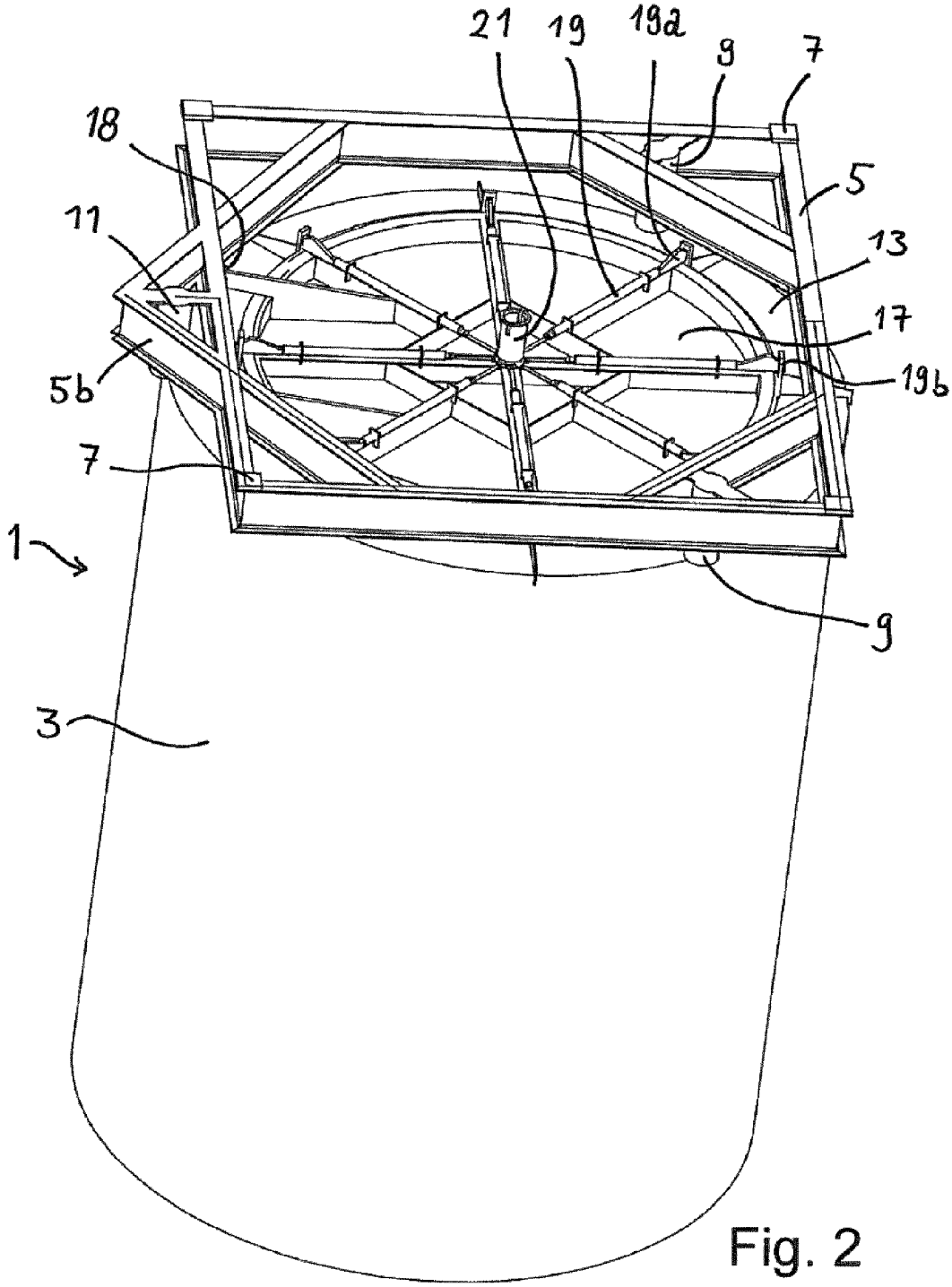
FIG. 2 is a perspective view of the anchor in FIG. 1, with the top hatch in the closed position.

When the hatch 17 is in the closed position, as shown in FIG. 2, the anchor is only open towards the downward direction, as the cylindrical body 3 is open in the bottom. The hatch 17 can be locked in this position with an ROV by rotating an ROV interface 21 arranged on top of the hatch 17. Here, the ROV interface 21 is an ROV torque bucket arranged to be rotated by the ROV. When rotated, a plurality of locking elements 19*a* are pushed into receiving locking loops 19*b*. The receiving locking loops 19*b* are arranged to the top plate 13 along the perimeter of the top aperture 15. Preferably, the locking elements 19*a* have an inclined upper face resulting in a downwardly directed force onto the top hatch 17 when the inclined faces of the locking elements 19*a* are moved against the locking loops 19*b*.

Figure 3:
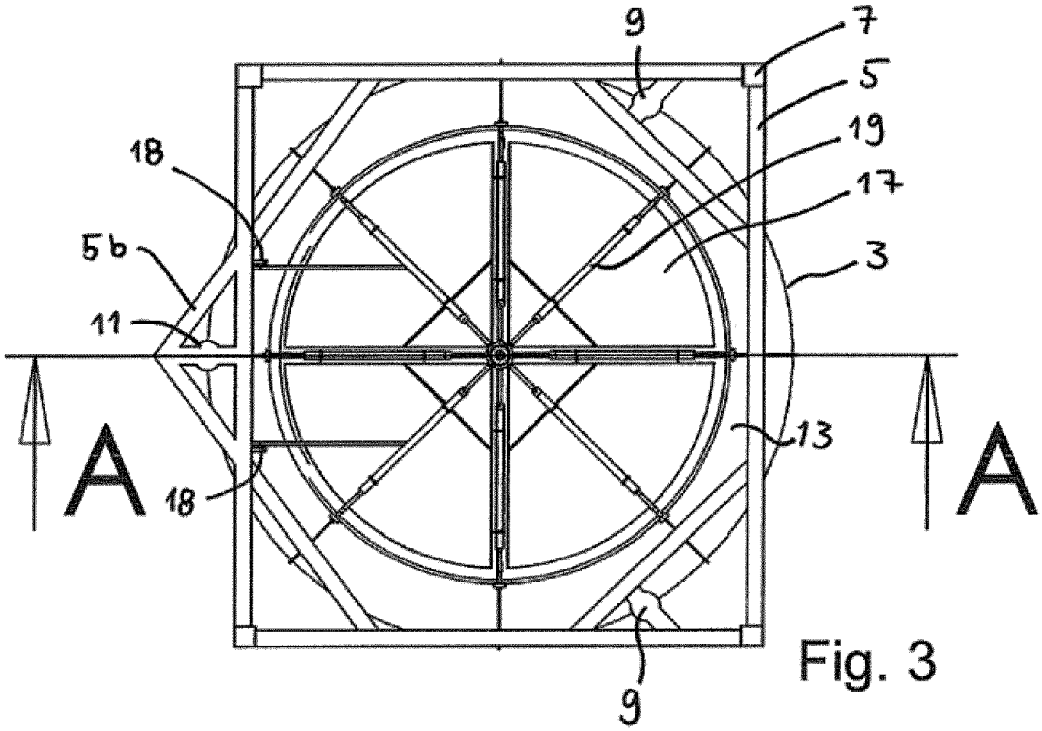
FIG. 3 is a top view of the anchor with the top hatch in the closed position.

FIG. 3 shows the anchor 1 as seen from above and with the hatch 17 in a closed position. In this view the central portion of the support frame 5 without any parts can be seen particularly clear. This central portion is larger than the extension of the top hatch 17, thereby rendering space for the opening and closing of the hatch 17 through the central portion.

Figure 4:
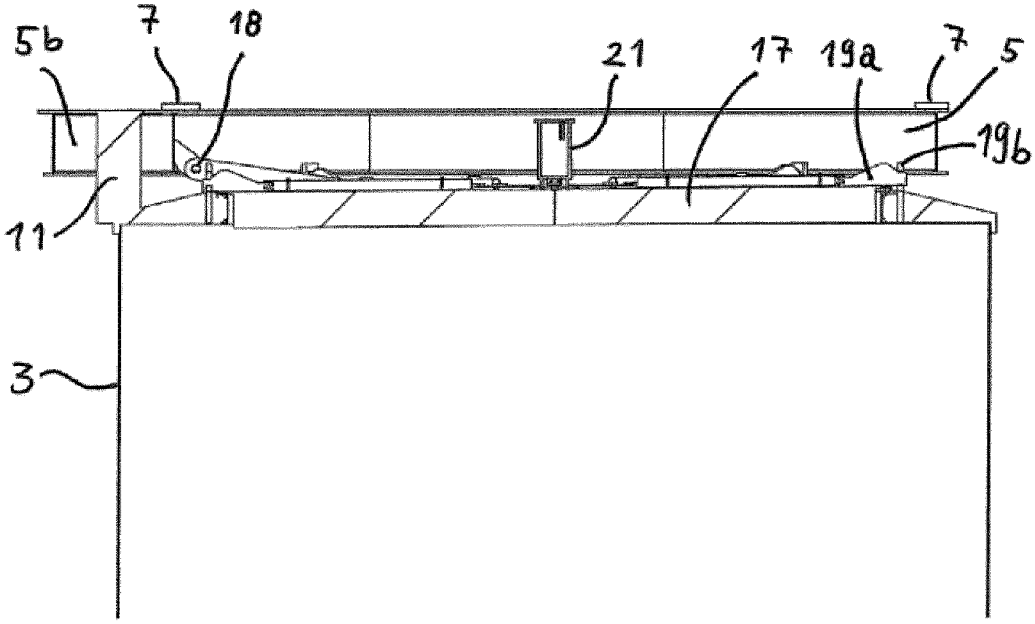
FIG. 4 is a side cross section view of the top section of the anchor.

FIG. 4 is a side cross section view of the section A-A in FIG. 3. This drawing shows the top hatch 17 in the closed position and the locking elements 19*a* inserted into the locking loops 19*b*, thus being in the locking position.

Figure 5:
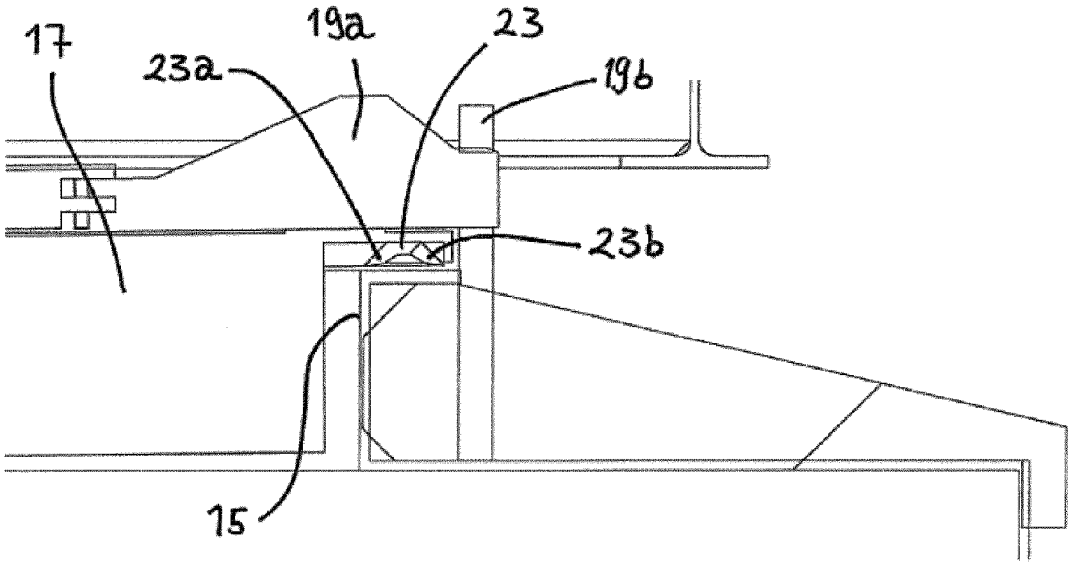
FIG. 5 is a cross section segment view of the top hatch and a sealing means.

A more detailed cross section view is shown in FIG. 5. A sealing gasket 23 is arranged to the top hatch 17 to seal against the top plate 13 of the anchor 1. It follows the perimeter of the top hatch 17 to ensure a complete sealing against the top plate 13 of the anchor. In this way, the operator is able to provide a positive or negative pressure inside the anchor 1 when the lower part of it has penetrated the seabed sufficiently to provide a closed space within the anchor. A liquid port (not shown) is arranged in the anchor so that the desired pressure can be delivered within the anchor 1.

Figure 6:
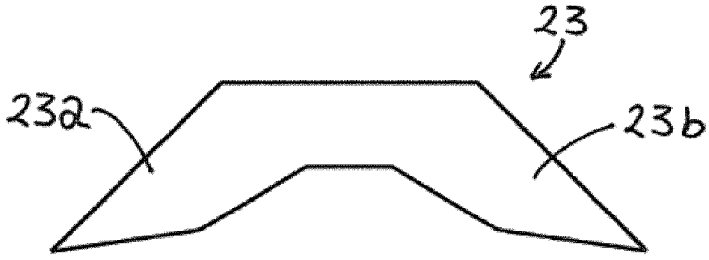
FIG. 6 is a cross section view of a sealing means between the top hatch and a top plate.

The gasket 23 is illustrated in more detail in FIG. 6, showing the gasket 23 with an enlarged cross section view. The gasket 23 is connected to the top hatch 17 in its upper part. This renders an inner lip 23*a* and an outer lip 23*b* free to move when being pressed against a facing sealing surface of the top plate 13. Furthermore, the two lips 23*a*, 23*b* extending in opposite radial directions ensures sealing function with a pressure drop over the gasket 23 in both directions. Thus, the gasket 23 will exhibit sealing function both when a positive or a negative pressure is provided within the anchor 1. For instance, with a positive pressure inside the anchor 1, the inner lip 23*a* will be pressed against the opposite sealing surface by the said pressure.

When lowering the anchor 1 towards the seabed from a floating installation, the top hatch 17 can be secured in its open position, as shown in FIG. 1, for instance with a rope that is cut when the anchor 1 has landed. When releasing the top hatch 17 from this position, it will simply fall down into its closed position by gravity. Due to the large resistance from the water, this falling movement will be sufficiently gentle so that damage to the gasket 23 or other parts is avoided.

Figure 7:
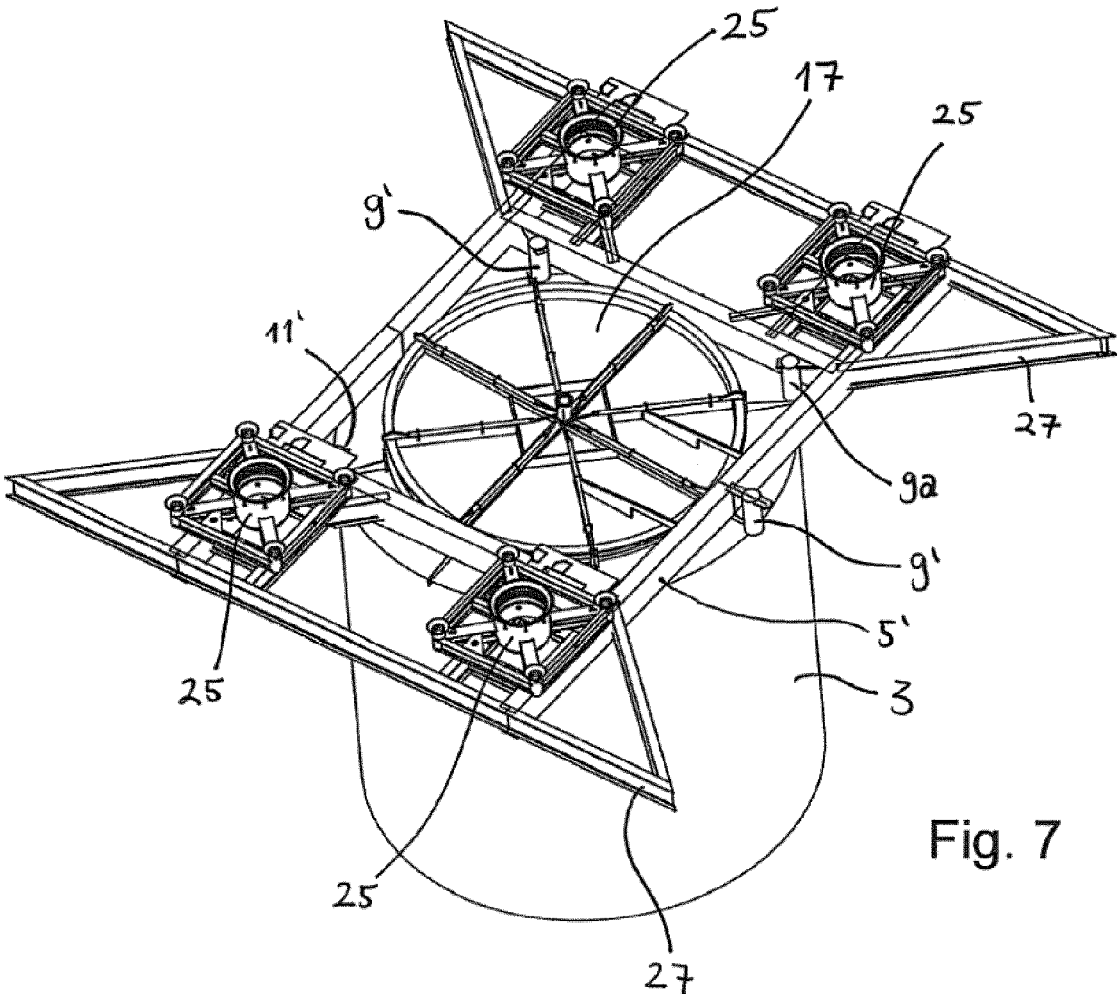
FIG. 7 is a perspective view of an alternative embodiment involving an assembly comprising an anchor according to the invention and a well template.

FIG. 7 shows a further embodiment of the subsea anchor 1' according to the present invention. In this embodiment the cylindrical body 3 has an outer diameter of 10 m, whereas the aperture 15 closed by the hatch 17 has a diameter of 7.5 m.

The support structure 5' of this embodiment is a well template with four well slots 25. In addition to the two levelling screws 9' and the ball joint 11 (not shown), as described above, the support frame 5' further comprises two adjustable support screws 9*a*, of which only one is visible in FIG. 7. After installation of the cylindrical body 3 in the seabed, the support frame 5' is levelled as described above by means of the levelling screws 9' about the ball joint 11'. Once levelled out, the two support screws are screwed downwards into contact with the top plate 13 of the anchor 1'. Thus, in the embodiment shown in FIG. 7 the support structure 5' comprises five support points (of which only three are visible in FIG. 7) against the upper part of the subsea anchor 1'. The support screws 9*a* have been arranged in addition to the levelling screws 9' and ball joint 11' due to the large weight which may be exerted onto the well slots 25 when installing a conductor casing, which may weigh several tens of tons.

When installing traditional well templates, it is common to arrange the template on a plurality, normally four, skirt anchors. In order to level the template, the penetration depth of each the anchors into the seabed is adjusted so that the template will be levelled when being supported by the anchors. With suction anchors, having a sealable top part, the wall thickness of the cylindrical body must then be dimensioned thick to withstand the possible pressure needed to penetrate sufficiently into the seabed during levelling. This is hence desirable to avoid.

On greater sea depths the seabed conditions tend to be poor in that the top section is loose and one needs to penetrate a large distance into the seabed before reaching more solid conditions. The conditions are moreover difficult to predict.

Thus, a solution involving a plurality of skirt anchors that rely on friction between the skirt and the seabed for carrying the weight on top of them will involve a large vertical dimension of the cylindrical bodies (skirts). Particularly when installing a well template in deep waters, for instance at 1000 meters or deeper, this implies a cumbersome and inappropriate solution.

Installing the template on only one large subsea anchor 1' as illustrated in the embodiment of FIG. 7 is therefore a more appropriate solution. Since the entire template rests on only one anchor 1', the penetration depth of the anchor 1' into the seabed does not have to be adjusted with respect to adjacent anchors. After penetration into the seabed, the well template can be levelled by the ROV-operated levelling screws 9' and one needs only to lower one anchor.

The embodiment described with reference to FIG. 7 is thus particularly well suited for large sea depths, such as 1000 meters or more.

In addition to the four well slots 25 shown in FIG. 7, the support frame 5' exhibits four protrusions 27 which extend the main rectangular shape of the support frame 5'. The purpose of these protrusions 27 is to connect to well template hatches (not shown) which can be arranged to protect the template and make the template overtrawlable. Such protective hatches are described in the international patent application publication WO 2010103002.

A manifold (not shown) can be arranged between two pairs of well slots 25.

The support frame 5' of the embodiment shown in FIG. 7 also differs from the support frame 5 described with reference to FIG. 1 in that it comprises beams with a rectangular box-shaped cross section. The box-shaped beams will withstand significantly larger torsion forces than the I-beams shown in FIG. 1. The protruding part 5*b* shown in FIG. 1 can therefore be avoided in the design shown in FIG. 7.

The invention claimed is:

1. A subsea anchor comprising:

a hollow cylindrical body extending down from a top part having a top aperture and a top hatch, which top hatch is adapted to close and open the top aperture, said top hatch being attached to a top plate with hinges, said cylindrical body being adapted to penetrate into a seabed, wherein:

an area of said top aperture is at least 30% of a corresponding cross section area encircled by the cylindrical body; and the subsea anchor comprises a support frame arranged to the top part, which support frame exhibits a central open portion, encircled by the support frame, which central open portion renders space for movement of the top hatch between an open and a closed position through the support frame, which support frame is adapted to receive subsea equipment when the subsea anchor is installed in the seabed.

2. The subsea anchor according to claim 1, wherein the area of the top aperture is at least approximately 50% of the corresponding cross section area encircled by the cylindrical body.

3. The subsea anchor according to claim 1, wherein the support frame comprises a well template with a plurality of well slots.

4. The subsea anchor according to claim 1, wherein the support frame comprises two levelling screws and two adjustable support screws.

5. The subsea anchor according to claim 1, wherein the cylindrical body exhibits a substantially circular shape and the cylindrical body has an outer diameter being more than approximately 3 meters and less than approximately 12 meters.

6. The subsea anchor according to claim 1, wherein the cylindrical body exhibits a substantially circular shape and the cylindrical body has an outer diameter being more than approximately 6 meters and less than approximately 10 meters.

7. The subsea anchor according claim 3, wherein the subsea anchor is penetrated into a seabed at a depth of more than approximately 1000 meters.

* * * * *